United States Patent [19]

Puskar

[11] Patent Number: 4,474,022

[45] Date of Patent: Oct. 2, 1984

[54] AMBIENT AIR ASSISTED COOLING SYSTEM

[75] Inventor: John R. Puskar, Parma Heights, Ohio

[73] Assignee: Standard Oil Company, Cleveland, Ohio

[21] Appl. No.: 454,712

[22] Filed: Dec. 30, 1982

[51] Int. Cl.[3] ..... F25D 17/06

[52] U.S. Cl. ..... 62/96; 62/181; 62/196.4; 62/227; 62/412

[58] Field of Search ..... 62/181, 196.4, 238.6, 62/428, 227, 229, 412, 96

[56] References Cited

U.S. PATENT DOCUMENTS

| | | | |
|---|---|---|---|
| 2,556,882 | 6/1951 | Minkler et al. | 62/226 |
| 3,134,241 | 5/1964 | Johnson | 62/196.4 |
| 3,188,829 | 6/1965 | Siewert et al. | 62/196.4 |
| 4,244,193 | 1/1981 | Haakenson | 62/412 |
| 4,257,238 | 3/1981 | Kountz et al. | 62/229 |
| 4,325,226 | 4/1982 | Schaeffer | 62/238.6 |
| 4,356,706 | 11/1982 | Baumgarten | 62/238.6 |

*Primary Examiner*—Ronald C. Capossela

*Attorney, Agent, or Firm*—David J. Untener; Larry W. Evans

[57] ABSTRACT

An ambient air assisted cooling system comprising: vapor-compression refrigeration means; air-cooled heat exchanger means; and means responsive to the temperature of the ambient air for advancing the matter to be cooled through said refrigeration means and/or said heat exchanger means. Said means for advancing said matter preferably comprises microprocessor means.

24 Claims, 1 Drawing Figure

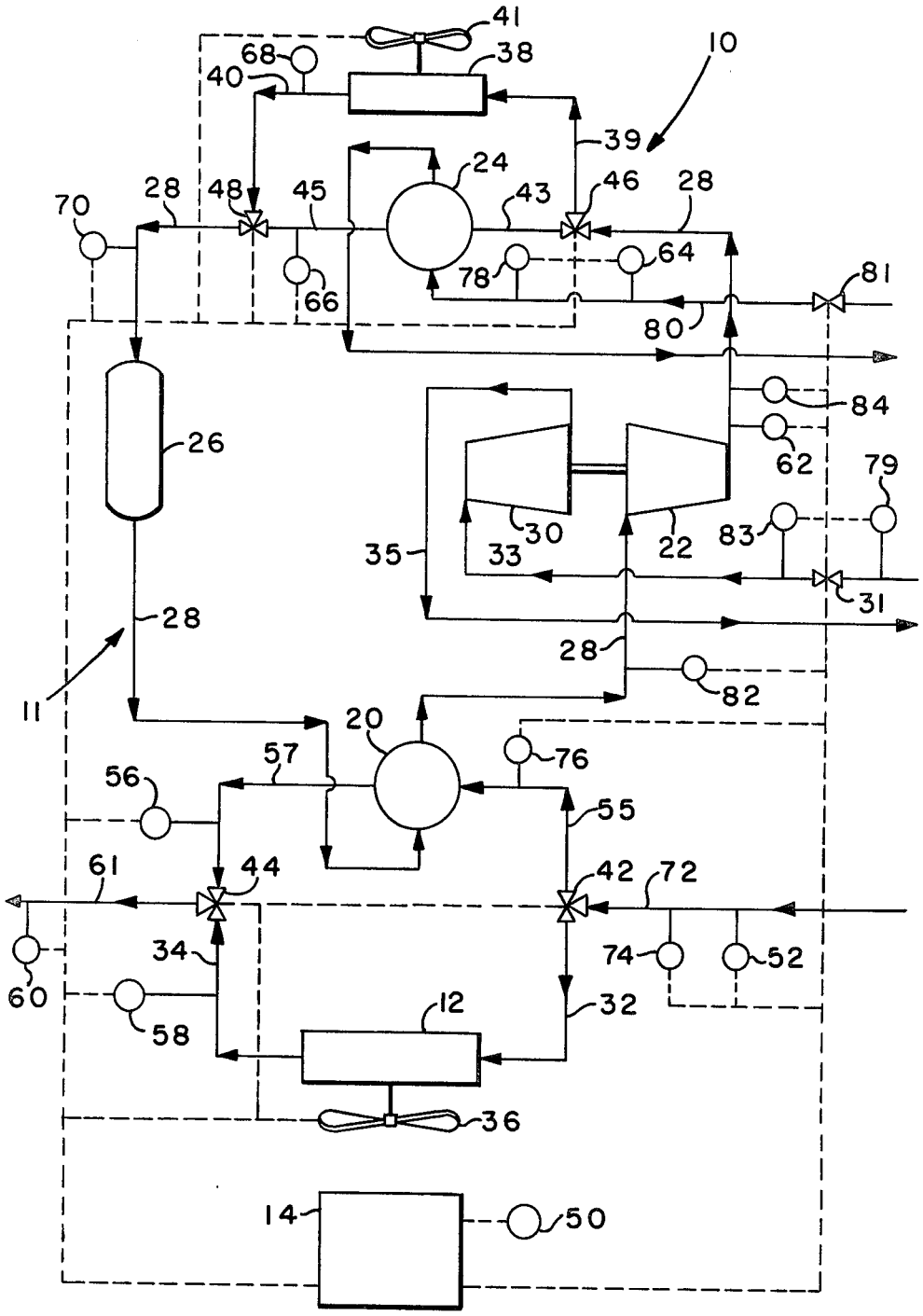
41
38
68
40
10
39
24
28
48
45
43
46
28
70
64
78
66
81
80
84
26
62
79
30
33
22
83
35
31
28
28
82
11
20
76
57
56
55
61
44
42
72
34
74
52
60
58
12
32
36
14
50

AMBIENT AIR ASSISTED COOLING SYSTEM

TECHNICAL FIELD

This invention relates to cooling systems and, more particularly, to ambient air assisted cooling systems. Specifically, this invention relates to vapor-compression refrigeration systems assisted by ambient air cooling during relatively cold weather periods.

BACKGROUND OF THE INVENTION

Vapor-compression refrigeration systems are used extensively for providing cooling in the treating, transportation, and preservation of foods and beverages and in numerous applications in a variety of chemical industries. For example, applications of these systems to petroleum refining include lubricating-oil purification, catalytic processes and condensation of volatile hydrocarbons. These systems are also prominent in other industries concerned with the separation of volatile materials by condensation. These include the production of nitrogen and oxygen from air, the manufacture of ice, and the dehydration or liquefaction of gases. Air-conditioning systems are another typical application of vapor-compression refrigeration systems.

Vapor-compression refrigeration systems typically include an evaporator wherein a refrigerant, such as ammonia, vaporizes and in the process of vaporizing provides a heat sink for absorbing heat from the matter being cooled. Vaporized refrigerant is advanced from the evaporator to a compressor and then to a condenser. In the condenser, heat is rejected from the refrigerant at a higher pressure and the refrigerant is liquefied. Liquefied refrigerant is advanced from the condenser to an expansion mechanism (e.g., expansion valve or a flash tank) and then returned to the evaporator to repeat the cycle. The degree of compression required in the compressor is dependent upon the temperature at which condensation occurs in the condenser. Typically, in most commercial and industrial refrigeration systems in use today, the heat rejection medium utilized in the condenser is cooling water which is usually maintained at temperatures in the range of about 65° F. to about 85° F. year-round, even though ambient air temperatures in many instances are significantly below the temperatures of such cooling waters.

Climatic weather conditions in many parts of the world, particularly the Northern Hemisphere, provide sufficiently cold temperatures at least part of the time that could be useful in supplementing the cooling capacity required of many of the above-described vapor-compression refrigeration systems. For example, in recent years, hourly temperature recordings for parts of northern Ohio indicate temperatures of 35° F. or below about 36% of the time. Temperatures of 55° F. or below have been similarly recorded for northern Ohio about 60% of the time. These temperatures are below the temperatures of cooling water typically used in many commercial and industrial refrigeration systems in use today and, in many instances, are below the temperatures required for the cooled materials treated by such systems.

It would be advantageous to provide a vapor-compression refrigeration system capable of utilizing the cooling capacities available from cold temperatures provided by climatic conditions during cold weather periods to supplement the cooling requirements of such systems and thereby reduce the cost and energy requirements of such systems.

SUMMARY OF THE INVENTION

The present invention contemplates the provision of an ambient air assisted cooling system wherein vapor-compression refrigeration cooling is provided during relatively warm weather periods and ambient air cooling is provided during relatively cold weather periods. Additionally, this system utilizes ambient air cooling to reduce the load required by such vapor-compression refrigeration systems during relatively cold weather periods.

Broadly stated, the present invention provides for an ambient air assisted cooling system comprising: vapor-compression refrigeration means; air-cooled heat exchanger means; and means responsive to the temperature of the ambient air for advancing the matter to be cooled through said refrigeration means and/or said heat exchanger means. In a preferred embodiment of the invention, said means for advancing said matter comprises microprocessor means. In a particularly advantageous embodiment of the invention, the system includes condenser means and secondary air-cooled heat exchanger means operatively connected to said refrigeration means, and means responsive to the temperature of said ambient air and the operating temperature of said condenser means for advancing the refrigerant utilized in said vapor-compression refrigeration means through said condenser means and/or said secondary air-cooled heat exchanger means.

A process for cooling matter with an ambient air-assisted cooling system is also provided in accordance with the present invention, said process comprising: providing an ambient air assisted cooling system, said system comprising vapor-compression refrigeration means, air-cooled heat exchanger means, and means responsive to the temperature of the ambient air for advancing said matter through said refrigeration means and/or said heat exchanger means; cooling said matter with said heat exchanger means when the temperature of said matter exceeds the ambient air temperature by a desired differential; and cooling said matter with said refrigeration means when the temperature of said matter does not exceed the ambient air temperature by said differential. In a preferred embodiment of this process, said ambient air assisted cooling system includes condenser means and secondary air-cooled heat exchanger means operatively connected to said refrigeration means, said process including the additional steps of advancing the refrigerant of said refrigeration means through said secondary air-cooled heat exchanger when the temperature of said ambient air is below a desired operating temperature for said condenser, and advancing said refrigerant through said condenser means when the temperature of said ambient air is above said desired operating temperature.

BRIEF DESCRIPTION OF THE DRAWING

The drawing is a schematic flow diagram which illustrates the ambient air assisted cooling system of the present invention in a particular form. The dashed connecting lines indicate electrical connecting lines.

DESCRIPTION OF THE PREFERRED EMBODIMENT

Further features and advantages of the present invention will become apparent from the detailed description of the preferred embodiment herein set forth.

The present invention, in the illustrated embodiment, comprises an ambient air assisted cooling system 10 which includes a vapor-compression refrigeration unit 11; an air-cooled heat exchanger 12 operatively connected to refrigeration unit 11; and a microprocessor 14 which is operatively connected to refrigeration unit 11 and heat exchanger 12, all as hereinafter further explained. Cooling system 10 is suitable for cooling any fluid stream (i.e., gaseous, liquid, etc.), solid stream, or stream consisting of a mixture of one or more fluids and/or one or more solids, such stream being referred to hereinafter as the "process stream".

Refrigeration unit 11 includes evaporator 20, compressor 22, condenser 24 and flash tank 26 operatively connected to each other by conduit 28 to provide a flow path for the continuous cycling of refrigerant through refrigeration unit 11. Steam turbine 30 is operatively connected to compressor 22 and is adapted for driving compressor 22. Evaporator 20, compressor 22, condenser 24, flash tank 26 and steam turbine 30 are entirely conventional in design and construction, the specific design and construction of such items being dependent upon the load requirements for refrigeration unit 11. For example, compressor 22 can be a ten-stage compressor manufactured by Elliott Company adapted for handling ammonia as the refrigerant; typical requirements for such a compressor are a shaft horsepower of about 1389 at 10,265 RPM and a polytropic head of about 95,600 feet assuming an ammonia input temperature of 25° F. and pressure of 53.7 PSIA and an ammonia output temperature of 356.7° F. and pressure of 286.4 PSIA and a flow rate of 364.4 pounds of ammonia per minute. As an alternative to steam turbine 30, an electric motor or a hydraulic turbine, for example, can be used. An expansion valve can be used in place of flash tank 26. Evaporator 20 and condenser 24 can be shell and tube heat exchangers of carbon steel construction with the refrigerant passing on the shell side of such heat exchangers. The process stream passes through evaporator 20 on the tube side. A suitable cooling medium such as, for example, cooling water is used on the tube side of condenser 24. An effective heat transfer area of about 1790 square feet, for example, would be required for evaporator 20 assuming a process stream of water at a rate of 800,000 pounds per hour having an input temperature of 60° F. and an output temperature of 45° F. and ammonia as the refrigerant having a flow rate of 21,862 pounds per hour and an input and an output temperature of 25° F. Under such circumstances evaporator 20 preferably has 319 tubes, each having a ¾" outside diameter and a length of 26.4 feet. An effective heat transfer area of about 2854 square feet, for example, would be required for condenser 24 assuming the above indicated flow rate of ammonia and a cooling water input temperature of 80° F. and output temperature of 110° F. and an ammonia input temperature of 356.7° F. and output temperature of 120° F. Under such circumstances condenser 24 preferably has 164 tubes, each having a ¾" outside diameter and a length of 88.6 feet. Typical requirements for steam turbine 30 are an input steam pressure of 600 PSIG and temperature of 720° F. and saturated steam at 6 inches Hg. on the output side: steam turbines adapted for handling a theoretical steam rate of about 8 pounds per kilowatt hour such as Elliott Model No. SB5 available from Elliott Company can be used. Refrigeration unit 11 is representative of the numerous designs and constructions of vapor-compression refrigeration units currently available. Such vapor-compression refrigeration units are entirely conventional in structure, design and operation and are described further, for example, in "Chemical Engineers Handbook", edited by John H. Perry, 4th Ed., pages 12-2 to 12-10, which is incorporated herein by reference.

The refrigerant employed in refrigeration unit 11 can be any of the well known refrigerants currently available for use in vapor-compression refrigeration applications. Included in the refrigerants that can be used are ammonia, methyl chloride, sulfur dioxide, propane and the halogenated hydrocarbons such as Freon-12 (dichlorodifluoromethane). Ammonia, which has wide spread application, is particularly preferred.

Heat exchanger 12 is an air-cooled heat exchanger that is operatively connected to refrigeration unit 11 by conduits 32 and 34. Similarly, heat exchanger 38 is an air-cooled heat exchanger that is operatively connected to refrigeration unit 11 by conduits 39 and 40. The process stream passes through heat exchanger 12 on the tube side. Refrigerant passes through heat exchanger 38 on the tube side. Heat exchangers 12 and 38 include fans 36 and 41, respectively, which force or induce ambient air to flow across a bank of tubes which are provided in heat exchangers 12 and 38. Heat exchangers 12 and 38 and fans 36 and 41 are entirely conventional in design and construction. For example, heat exchanger 12 requires an effective heat transfer of about 5016 square feet assuming carbon steel construction, an ambient air temperature of 25° F. and water as the process stream at a rate of 800,000 pounds per hour and having an input temperature of 60° F. and an output temperature of 45° F. Under such circumstances, heat exchanger 12 preferably has two bays, each of such bays being about 14 feet by 40 feet. Heat exchanger 38 requires an effective heat transfer area of about 2837 square feet assuming carbon steel construction, an ambient air temperature of 60° F., the input and output temperature of the refrigerant is 120° F. and the flow rate of the refrigerant is 21,862 pounds per hour. Under such circumstances heat exchanger 38 preferably has two bays, each bay being 12 by 36 feet and having three rows of tubes. Air-cooled heat exchangers of the type useful in accordance with the present invention are described in "Chemical Engineers Handbook", supra, pages 11-15 to 11-20, which is incorporated herein by reference.

Heat exchanger 12 is interconnected with refrigeration unit 11 by three-way pneumatically operated valves 42 and 44. Similarly, heat exchanger 38 is interconnected with refrigeration unit 11 by three-way pneumatically operated valves 46 and 48. The operation of valves 42, 44, 46 and 48 is controlled by microprocessor 14. Valves 42, 44, 46 and 48 are entirely conventional in design and construction.

Cooling system 10 includes temperature sensing mechanisms 50, 52, 56, 58, 60, 62, 64, 66, 68 and 70, all of which are electrically connected to microprocessor 14. Temperature sensor 50 is adapted for sensing the ambient air temperature. Sensor 52 is adapted for sensing the temperature of the process stream as it enters cooling system 10 through conduit 72. Sensor 56 is adapted for sensing the temperature of the process stream leaving evaporator 20 through conduit 57. Sensor 58 is adapted for sensing the temperature of the process stream leaving heat exchanger 12 through conduit 34. Sensor 60 is adapted for sensing the temperature of the cooled process stream leaving cooling system 10 through conduit 61. Sensor 62 is adapted for sensing the temperature of refrigerant leaving compressor 22 through conduit 28. Sensor 64 is adapted for sensing the temperature of cooling water entering condenser 24 through conduit 80. Sensor 66 is adapted for sensing the temperature of refrigerant leaving condenser 24 through conduit 45. Sensor 68 is adapted for measuring the temperature of refrigerant leaving heat exchanger 38 through conduit 40. Sensor 70 is adapted for sensing the temperature of refrigerant entering flash tank 26 through conduit 28. Temperature sensors 50, 52, 56, 58, 60, 62, 64, 66, 68 and 70 are entirely conventional in design and construction.

Cooling system 10 also includes flow sensing mechanisms 74, 76, 78 and 79. Each of the flow sensors 74, 76, 78 and 79 are electrically connected to microprocessor 14. Flow sensor 74 is adapted for sensing the rate of flow of the process stream through conduit 72 as such process stream enters cooling system 10. Flow sensor 76 is adapted for sensing the flow rate of the process stream entering evaporator 20. Flow sensor 78 is adapted for sensing the flow rate of cooling water entering condenser 24 through conduit 80. Flow sensor 79 is adapted for sensing the flow rate of steam entering steam turbine 30 through conduit 33. Flow sensing mechanisms 74, 76, 78 and 79 are entirely conventional in design and construction.

Cooling system 10 also includes pressure sensing mechanisms 82, 83 and 84 which are electrically connected to microprocessor 14. Pressure sensor 82 is adapted for sensing the pressure of refrigerant entering compressor 22. Pressure sensor 83 is adapted for sensing the pressure of steam entering steam turbine 30. Pressure sensor 84 is adapted for sensing the pressure of refrigerant leaving compressor 22. Pressure sensors 82, 83 and 84 are entirely conventional in design and construction.

Microprocessor 14 is adapted for controlling the flow of the process stream and refrigerant through cooling system 10 by controlling the movements of valves 31, 42, 44, 46, 48 and 81 along with the movement of fans 36 and 41 in response to signals received from temperature sensors 50, 52, 56, 58, 60, 62, 64, 66, 68 and 70, flow sensors 74, 76 and 78 and pressure sensors 82 and 84. Microprocessor 14 is preferably a multiple loop distributed control system microprocessor with logic capability, such microprocessors being entirely conventional in design and construction. For example, a Honeywell TDC 2000 microprocessor or its equivalent could be used.

The process stream to be cooled enters cooling system 10 through conduit 72. Sensors 52 and 74 transmit the temperature and flow rate, respectively, of the process stream to microprocessor 14 as the process stream passes through conduit 72. Temperature sensor 50 senses and transmits the ambient air temperature to microprocessor 14. Microprocessor 14 compares the temperature of the process stream in conduit 72 to the ambient air temperature. If the temperature of such process stream exceeds the ambient air temperature by a desired differential, microprocessor 14 is programmed to activate valve 42 to permit the flow of the process stream through conduit 32 to heat exchanger 12. The differential for employing heat exchanger 12 is dependent upon the cooling efficiencies of heat exchanger 12 and evaporator 20, but can be, for example, at least about 5° F., preferably at least about 10° F. The process stream passes through heat exchanger 12 on the tube side. Fan 36 is activated by microprocessor 14 in response to the cooling requirements of heat exchanger 12. The cooling requirements for heat exchanger 12 are dependent upon the flow rate of the process stream passing through it and the desired level of cooling or reduction in temperature for the process stream. The temperature of the process stream leaving heat exchanger 12 through conduit 34 is sensed by temperature sensor 58 and transmitted to microprocessor 14. The rate of rotation of fan 36 is adjusted in response to the temperature of the process stream as it leaves heat exchanger 12. If additional cooling is required, microprocessor 14 is programmed to increase the rate of rotation of fan 36. If reduced cooling is required, microprocessor 14 is programmed to reduce the rate of rotation of fan 36. Valve 44 is activated by microprocessor 14 to permit the passage of the process stream from heat exchanger 12 through conduits 34 and 61. The cooled process stream leaves system 10 through conduit 61. Temperature sensor 60 transmits the temperature of the process stream in conduit 61 to microprocessor 14. When the process stream is cooled in heat exchanger 12, microprocessor 14 is programmed to deactivate refrigeration unit 11 by closing valve 31 to deactivate steam turbine 30 and compressor 22 and thereby provide savings in operating cost and energy.

If the temperature of the process stream in conduit 72 does not exceed the ambient air temperature by the above-indicated desired differential, microprocessor 14 is programmed to activate valve 42 to permit the flow of the process stream through conduit 55 to evaporator 20. The process stream is cooled in evaporator 20 by the refrigerant which passes through the shell side of evaporator 20. The refrigerant vaporizes in evaporator 20, preferably at a constant temperature, and in so doing provides a heat sink for the process stream. The cooled process stream leaves evaporator 20 through conduit 57. The temperature of the process stream in conduit 57 is transmitted to microprocessor 14 by temperature sensor 56. Valve 44 is activated by microprocessor 14 to permit the process stream to advance from conduit 57 through conduit 61 to leave cooling system 10. Temperature sensor 60 transmits the temperature of the process stream in conduit 61 to microprocessor 14.

Refrigerant enters the shell side of evaporator 20 in liquid form and leaves evaporator 20 in vapor form. The vaporized refrigerant is advanced through conduit 28 to compressor 22 wherein it is compressed to a higher pressure. Compressor 22 is driven by steam turbine 30. Steam turbine 30 is driven by steam which enters it through conduit 33 and leaves it through conduit 35. The flow of steam through steam turbine 30 and thus the rate of rotation of steam turbine 30 and compressor 22 is controlled by valve 31. Valve 31 is activated by microprocessor 14 in response to the pressure of the compressed refrigerant leaving compressor 22, such pressure being transmitted to microprocessor 14 by pressure sensor 84, and the flow rate and pressure of the steam entering steam turbine 30 through conduit 33, such steam flow rate and pressure being transmitted to microprocessor 14 by sensors 79 and 83, respectively. The compressed vaporized refrigerant is advanced from compressor 22 through conduit 28 to valve 46.

Condensor 24 has a desired optimum operating temperature which is dependent upon the design and construction of such condenser. Typically, the optimum operating temperature for water-cooled condensers such as condenser 24 is in the range of about 30° F. to about 200° F., preferably about 50° F. to about 180° F., more preferably about 90° F. to about 150° F., and advantageously about 120° F. Generally, the optimum operating temperature for condenser 24 is the temperature of the cooling medium used (e.g., cooling water) plus an additional incremental amount, for example about 20° F. to about 40° F. If the ambient air temperature is below the optimum operating temperature of condenser 24, microprocessor 14 is programmed to activate valve 46 to permit the flow of refrigerant through conduit 39 to heat exchanger 38. Refrigerant passes through the tube side of heat exchanger 38 and leaves heat exchanger 38 through conduit 40. Temperature sensor 68 transmits the temperature of the refrigerant in conduit 40 to microprocessor 14. On the other hand, if the ambient air temperature is above the optimum operating temperature of condenser 24, microprocessor 14 is programmed to activate valve 46 to permit the flow of refrigerant through conduit 43 to condenser 24. Refrigerant passes through the shell side of condenser 24 and leaves condenser 24 through conduit 45. Cooling water passes through the tube side of condenser 24. The flow rate and temperature of such cooling water is transmitted to microprocessor 14 by sensors 78 and 64, respectively. The flow rate of the cooling water is controlled by valve 81 which is activated and controlled by microprocessor 14. Temperature sensor 66 transmits the temperature of refrigerant in conduit 45 to microprocessor 14.

The power input into compressor 22 is less when refrigerant advances through heat exchanger 38 than when the refrigerant advances through condenser 24 due to the fact that when heat exchanger 38 is employed the cooling medium in heat exchanger 38 is colder than the cooling medium in condenser 24 and, consequently, the pressure required for the refrigerant entering heat exchanger 38 is less than the pressure required of refrigerant entering condenser 24. Under such circumstances microprocessor 14 is programmed to activate valve 31 to reduce the power input into steam turbine 30.

In the event the ambient air temperature is sufficiently low enough to permit cooling of the refrigerant in heat exchanger 38 and temperature sensor 70 indicates that the cooling capacity being provided by heat exchanger 38 is not sufficient to cool the refrigerant to the extent desired, the load requirements on heat exchanger 38 can be supplemented by diverting part of the flow of refrigerant through condenser 24. The degree of diversion through condenser 24 is adjusted by microprocessor 14 until temperature sensor 70 indicates that the desired level of cooling has been achieved. The flow rate of refrigerant through heat exchanger 38 and condenser 24 are computed by microprocessor 14 based on the readings from temperature sensors 66, 68, and 70. Microprocessor 14 is programmed to throttle valve 46 to permit the desired rate of flow of refrigerant through conduits 39 and 43. Valve 48 is correspondingly adjusted by microprocessor 14 to permit the desired flow of refrigerant through conduits 40 and 45 into conduit 28.

Refrigerant is advanced through conduit 28 to flash tank 26 where it is returned to its original state by expansion. Refrigerant is then advanced from flash tank 26 through conduit 28 to evaporator 20 to repeat the cycle.

In the event the ambient air temperature is sufficiently low enough to permit cooling of the process stream in heat exchanger 12 and temperature sensor 60 indicates that the cooling capacity being provided by heat exchanger 12 is not sufficient to cool the process stream to the extent desired, the load requirements on heat exchanger 12 can be supplemented by diverting part of the flow of the process stream through evaporator 20. The degree of diversion through evaporator 20 is adjusted by microprocessor 14 until temperature sensor 60 indicates that the desired level of cooling has been achieved. The required flow rates of the process stream through heat exchanger 12 and evaporator 20, respectively, are computed by microprocessor 14 based on the readings from flow sensors 72 and 76 and temperature sensors 56, 58 and 60. Microprocessor 14 is programmed to throttle valve 42 to permit the desired rate of flow of process stream through heat exchanger 12 and evaporator 20. Valve 44 is correspondingly adjusted by microprocessor 14 to permit the desired flow of process stream through conduits 34 and 57 into conduit 61.

An advantage of the cooling system of the present invention is that savings in energy consumption of about 50% to about 60% can be realized in relatively cold or seasonal climates such as experienced in Ohio. In colder climates such savings can be even greater.

While the invention has been explained in relation to its preferred embodiments, it is to be understood that various modifications thereof will become apparent to those skilled in the art upon reading this specification. Therefore, it is to be understood that the invention disclosed herein is intended to cover such modifications as fall within the scope of the appended claims.

I claim:

1. An ambient air assisted cooling system comprising:
vapor-compression refrigeration means;
air-cooled heat exchanger means; and
means responsive to the temperature of the ambient air for advancing the matter to be cooled through said refrigeration means and/or said heat exchanger means;
said refrigeration means including condenser means and secondary air-cooled heat exchanger means operatively connected in parallel to said refrigeration means and means responsive to the temperature of the ambient air and the operating temperature of said condenser means for advancing the refrigerant of said refrigeration means through said condenser means and/or said secondary air-cooled heat exchanger means.

2. The system of claim 1 wherein said means for advancing said matter comprises microprocessor means.

3. The system of claim 1 wherein said refrigeration means further comprises compressor means, expansion means, evaporator means, and means for advancing said refrigerant in a continuous cycle through said compressor means, condenser means and/or secondary air-cooled heat exchanger means, expansion means and evaporator means.

4. The system of claim 3 with means for driving said compressor means.

5. The system of claim 3 wherein said expansion means comprises flash tank means or expansion valve means.

6. The system of claim 3 wherein said evaporator means comprises shell and tube heat exchanger means.

7. The system of claim 1 wherein said means for advancing said refrigerant comprises microprocessor means.

8. The system of claim 1 wherein said condenser means comprises shell and tube heat exchanger means.

9. The system of claim 1 wherein said air-cooled heat exchanger means comprises at least one air-cooled heat exchanger.

10. The system of claim 1 wherein said secondary air-cooled heat exchanger means comprises at least one air-cooled heat exchanger.

11. The system of claim 1 with means for comparing the temperature of said matter to be cooled and the temperature of said ambient air, means for advancing said matter through said air-cooled heat exchanger means when the temperature of said matter exceeds the ambient air temperature by a desired differential, and means for advancing said matter through said refrigeration means when the temperature of said matter does not exceed the ambient air temperature by said differential.

12. The system of claim 11 wherein said means for comparing the temperature of said matter to be cooled to the temperature of said ambient air comprises microprocessor means.

13. The system of claim 1 with means for comparing the temperature of said ambient air to a desired operating temperature for said condenser means, means for advancing the refrigerant of said refrigeration means through said secondary air-cooled heat exchanger means when said ambient air temperature is below said desired operating temperature, and means for advancing said refrigerant through said condenser means when said ambient air temperature is above said desired operating temperature.

14. The system of claim 13 wherein said means for comparing the temperature of said ambient air to said desired operating temperature comprises microprocessor means.

15. A process for cooling matter with an ambient air assisted cooling system comprising:

providing an ambient air assisted cooling system, said system comprising vapor-compression refrigeration means, air-cooled heat exchanger means, and means responsive to the temperature of the ambient air for advancing said matter through said refrigeration means and/or said heat exchanger means said refrigeration means including condenser means and secondary air-cooled heat exchanger means operatively connected in parallel to said refrigeration means and means responsive to the temperature of the ambient air and the operating temperature of said condenser means for advancing the refrigerant of said refrigeration means through said condenser means and/or said secondary air-cooled heat exchanger means;

advancing said refrigerant through said secondary air-cooled heat exchanger means when the temperature of said ambient air is below a desired operating temperature for said condenser means, and advancing said refrigerant through said condenser means when the temperature of said ambient air is above said desired operating temperature;

cooling said matter with said heat exchanger means when the temperature of said matter exceeds the ambient air temperature by a desired differential; and cooling said matter with said refrigeration means when the temperature of said matter does not exceed the ambient air temperature by said differential.

16. The process of claim 15 wherein said differential is at least about 5° F.

17. The process of claim 16 wherein said differential is at least about 10° F.

18. The process of claim 15 wherein said matter comprises a fluid.

19. The process of claim 15 wherein said matter comprises solids, liquid, gas or a mixture of solids, liquid and/or gas.

20. The process of claim 15 with the steps of dividing said matter to be cooled into separate parts, advancing one of said parts through said vapor-compression refrigeration means, advancing the other of said parts through said air-cooled heat exchanger means, and combining said parts.

21. The process of claim 15 wherein said desired operating temperature is in the range of about 30° F. to about 200° F.

22. The process of claim 15 wherein said desired operating temperature is in the range of about 50° F. to about 180° F.

23. The process of claim 15 wherein said desired operating temperature is the temperature of the cooling medium employed in said condenser means plus an incremental amount of about 20° F. to about 40° F.

24. The process of claim 15 wherein said process includes the steps of dividing said refrigerant into separate parts, advancing one of said parts through said condenser means, advancing the other of said parts through said secondary air-cooled heat exchanger means, and combining said parts.

* * * * *